US012522990B1

(12) United States Patent
Jin et al.

(10) Patent No.: US 12,522,990 B1
(45) Date of Patent: Jan. 13, 2026

(54) BRIDGE SLIDING DEVICE AND A BRIDGE CONSTRUCTION SYSTEM

(71) Applicant: POLY CHANGDA ENGINEERING CO., LTD., Guangzhou (CN)

(72) Inventors: He Jin, Guangzhou (CN); Yuxian Wu, Guangzhou (CN); Qicai Zhao, Guangzhou (CN); Xudong Wu, Guangzhou (CN); Shengquan Yan, Guangzhou (CN); Chenghong Liu, Guangzhou (CN); Biao Guo, Guangzhou (CN); Duo Zou, Guangzhou (CN); Xi Jia, Guangzhou (CN)

(73) Assignee: POLY CHANGDA ENGINEERING CO., LTD., Guangdong (CN)

( * ) Notice: Subject to any disclaimer, the term of this patent is extended or adjusted under 35 U.S.C. 154(b) by 0 days.

(21) Appl. No.: 19/226,131

(22) Filed: Jun. 2, 2025

Related U.S. Application Data

(63) Continuation-in-part of application No. 18/885,632, filed on Sep. 14, 2024.

(51) Int. Cl.
*E01D 21/06* (2006.01)

(52) U.S. Cl.
CPC ..... *E01D 21/065* (2013.01)

(58) Field of Classification Search
CPC ..... E01D 21/065; E01D 21/06; E01D 21/00; E01D 22/00
See application file for complete search history.

(56) References Cited

U.S. PATENT DOCUMENTS 3,490,605 A * 1/1970 Koss ..... E01D 21/00 212/175
3,492,683 A * 2/1970 Kinzel ..... E01D 15/127 14/2.5
3,925,840 A * 12/1975 Wagner ..... E01D 15/127 14/2.4

(Continued)

FOREIGN PATENT DOCUMENTS

CN 207047712 U 2/2018
CN 109958051 A 7/2019

(Continued)

OTHER PUBLICATIONS

Hongguang Guo, Tiantao He, Zhe Peng, New Baishatuo Yangtze River Bridge steel girder across the existing line pushing construction technology, journal, May 28, 2016, vol. 03, World bridge, China.

*Primary Examiner* — Abigail A Risic
(74) *Attorney, Agent, or Firm* — Ming Jiang; OPENPTO US LLC

(57) ABSTRACT

A bridge sliding device includes a slide rail assembly, a first sliding component on the rail, and a second sliding component on the first. The second component locks at the start of the first, and the bridge deck truss's weight causes the first component's end to tilt slightly, allowing it to easily cross the junction between the temporary support platform and the bridge pier. This facilitates the smooth crossing of both the first and second components over the junction. Once the first sliding component is in place, the second component unlocks and continues sliding, increasing the travel distance of the bridge deck truss. The device ensures smoother movement of the components, enhancing construction efficiency.

10 Claims, 4 Drawing Sheets

(56) References Cited

U.S. PATENT DOCUMENTS

| | | | | | |
|---|---|---|---|---|---|
| 4,087,220 | A * | 5/1978 | Koss | E01D 21/105 | 249/20 |
| 4,972,538 | A * | 11/1990 | Parramore | E01D 15/127 | 14/2.4 |
| 5,329,652 | A * | 7/1994 | Wiedeck | E01D 15/133 | 14/2.5 |
| 5,495,631 | A * | 3/1996 | Connor | E01D 15/14 | 14/27 |
| 5,511,266 | A * | 4/1996 | Dinis | E01D 21/06 | 14/2.5 |
| 5,511,268 | A * | 4/1996 | Albus | E01D 21/06 | 212/312 |
| 8,671,490 | B1 * | 3/2014 | Carney | E01D 22/00 | 14/2.4 |
| 2004/0111815 | A1 * | 6/2004 | Fuessinger | E01D 19/005 | 14/77.1 |
| 2009/0064427 | A1 * | 3/2009 | Emrich | E01D 15/127 | 14/2.5 |
| 2022/0081854 | A1 * | 3/2022 | Lin | E01D 19/042 | |

FOREIGN PATENT DOCUMENTS

| | | | |
|---|---|---|---|
| CN | 112144403 | A | 12/2020 |
| CN | 115030064 | A | 9/2022 |
| CN | 115233568 | A | 10/2022 |
| CN | 115404783 | A | 11/2022 |
| CN | 116136079 | A | 5/2023 |
| CN | 116905387 | A | 10/2023 |
| CN | 117286806 | A | 12/2023 |
| JP | 2000178922 | A | 6/2000 |
| JP | 2009079395 | A | 4/2009 |

* cited by examiner

BRIDGE SLIDING DEVICE AND A BRIDGE CONSTRUCTION SYSTEM

CROSS REFERENCE TO RELATED APPLICATIONS

The present application claims priority under 35 U.S.C. 119 (e) from China patent application No. 2023114448879, filed on Nov. 1, 2023, and is a continuation-in-part of a U.S. non-provisional patent application Ser. No. 18/885,632, filed on Sep. 14, 2024.

TECHNICAL FIELD

The present application relates to the technical field of bridge construction, and more specifically, to a bridge sliding device and a bridge construction system.

BACKGROUND

In certain bridge constructions, bridges can be built using the method of incremental launching, which is cost-effective and ensures smooth construction. During construction, a temporary support platform is set up on both sides of the bridge pier, and the bridge deck truss slides to the top of the pier via a slider and rail. However, the pressure of the bridge deck truss is transmitted to the support platform through the slider, causing the platform to deform, while the bridge pier itself does not undergo deformation. This results in the height of the platform under the pressure of the bridge deck truss being lower than that of the pier, creating a step-like structure due to the height difference when the slider moves from the platform onto the pier, hindering the smooth sliding of the truss onto the pier, thus affecting the incremental launching process.

SUMMARY

In view of this, there is a need to address the problem of the slider on the bridge deck truss not sliding smoothly from the support platform onto the pier, thereby affecting the incremental launching process, and to provide a bridge sliding device and a bridge construction system.

A bridge sliding device includes a slide rail assembly, a first sliding component, and a second sliding component. The slide rail assembly includes a rail that spans across the temporary support platform and the bridge pier and is arranged in a transverse direction, which is the direction from the temporary support platform to the bridge pier. The first sliding component is slidably arranged on the rail, with opposite ends respectively forming a sliding start and a sliding end, and the direction from the sliding start to the sliding end is the transverse direction. The second sliding component is unlockably locked onto the sliding start of the first sliding component and can slide from the sliding start to the sliding end of the first sliding component. The second sliding component is used to support the bridge deck truss. The length of the second sliding component is less than that of the first sliding component, and the length of the first sliding component is less than that of the rail.

In one embodiment, the bridge sliding device further includes a locking assembly arranged on the first sliding component. In the initial state, the locking assembly is used to lock the second sliding component at the sliding start of the first sliding component. After the first sliding component slides into place, the locking assembly is used to unlock the second sliding component.

In one embodiment, the locking assembly includes a locking pin, a locking pushrod, and a pushrod reset mechanism. The first sliding component has a first locking hole on the side facing the second sliding component, and the second sliding component has a second locking hole on the side facing the first sliding component. One end of the locking pin is inserted into the first locking hole, and the other end can be inserted into the second locking hole. The first sliding component also has a moving hole communicating with the first locking hole, which runs through the sliding end. One end of the locking pushrod is movably inserted into the moving hole along the transverse direction. The pushrod reset mechanism applies a reset force along the transverse direction to the locking pushrod, allowing it to move within the moving hole, driving the locking pin from the second locking hole to the first locking hole, disengaging the second locking hole.

In one embodiment, the locking pushrod has a relief groove on the side facing the first locking hole, and the other end extends out of the moving hole. The locking pushrod moves in the direction from the sliding end to the sliding start, aligning the relief groove with the first locking hole, allowing the locking pin to drop from the second locking hole into the first locking hole and the relief groove.

In one embodiment, one end of the locking pin is inserted through the first locking hole into the moving hole. The portion of the locking pin located within the moving hole has a locking groove on the side facing the locking pushrod. The locking groove forms a contact slope, inclined along the transverse direction, away from the second locking hole. One end of the locking pushrod can contact the contact slope. The locking assembly further includes a locking reset mechanism that applies a reset force to the locking pin along the direction from the first locking hole to the second locking hole.

In one embodiment, the sliding end of the first sliding component is provided with a stop, and a sliding slot is formed on the first sliding component in the transverse direction. The second sliding component is slidably arranged within the sliding slot and can slide within it and contact the stop.

In one embodiment, the slide rail assembly further includes a limiting member movably arranged on the rail. The direction of movement of the limiting member relative to the rail is the transverse direction, and the first sliding component can slide on the rail and contact the limiting member.

In one embodiment, the length of the first sliding component is less than the length of the temporary support platform in the transverse direction.

In one embodiment, the friction coefficient between the first sliding component and the rail is less than the friction coefficient between the second sliding component and the first sliding component.

A bridge construction system includes a temporary support platform and the above-mentioned bridge sliding device. The temporary support platform is set up on one side of the bridge pier. The slide rail assembly spans the temporary support platform and the pier, allowing the first sliding component to slide along the rail from the temporary support platform to the pier, and the second sliding component can slide from the sliding start to the sliding end of the first sliding component.

In one embodiment, the bridge construction system further includes a pushing assembly set on the temporary support platform, which is used to push the bridge deck truss in the transverse direction.

In one embodiment, the bridge construction system further includes a jacking assembly set on the temporary support platform. The jacking assembly can move up and down relative to the platform and is used to lift the bridge deck truss from the second sliding component.

During construction, the bridge sliding device and the bridge construction system first set up temporary support platforms on both sides of the pier and then install the slide rail assembly across the temporary support platform and the pier, positioning the rail of the slide rail assembly in the transverse direction of the bridge deck truss. Due to the higher deformation resistance of the pier compared to the temporary support platform, the pressure from the bridge deck truss on the temporary support platform causes it to deform, leading to a height difference between the temporary support platform and the pier, which affects the movement of the bridge deck truss in the transverse direction. The first sliding component is set on the rail, and the second sliding component is set on the first sliding component, with the second sliding component being shorter than the first sliding component. When the first sliding component is aligned with the temporary support platform, the second sliding component is locked at the sliding start of the first sliding component, and the bridge deck truss is set on the second sliding component. The weight of the bridge deck truss, applied through the second sliding component to the sliding start of the first sliding component, causes the sliding end of the first sliding component to slightly tilt upwards. As the first sliding component slides on the rail, its sliding end can easily cross the junction between the temporary support platform and the pier. When the second sliding component moves with the first sliding component to the junction, the sliding end of the first sliding component has already moved onto the pier, allowing the sliding start of the first sliding component to more easily cross the junction, thereby making it easier for the second sliding component to cross the junction as well. After the first sliding component is in position, the locking of the second sliding component relative to the first sliding component can be released, allowing the bridge deck truss to push the second sliding component to continue sliding from the sliding start to the sliding end of the first sliding component, increasing the travel distance of the bridge deck truss in the transverse direction. This bridge sliding device, by utilizing the cooperation between the first sliding component and the second sliding component, allows the second sliding component to more smoothly cross the junction between the temporary support platform and the pier, ensuring the efficiency of the bridge deck truss's incremental launching construction.

BRIEF DESCRIPTION OF THE DRAWINGS

The drawings that form part of this application are intended to provide a further understanding of the invention. The exemplary embodiments of the invention and their descriptions are used to explain the invention and do not constitute an undue limitation of the invention.

To clearly illustrate the technical solutions of the embodiments of the present invention, the drawings required for the description of the embodiments are briefly introduced below. It is evident that the following described drawings are merely some embodiments of the invention. For those skilled in the art, other drawings can be obtained based on these drawings without inventive effort.

Figure 1:
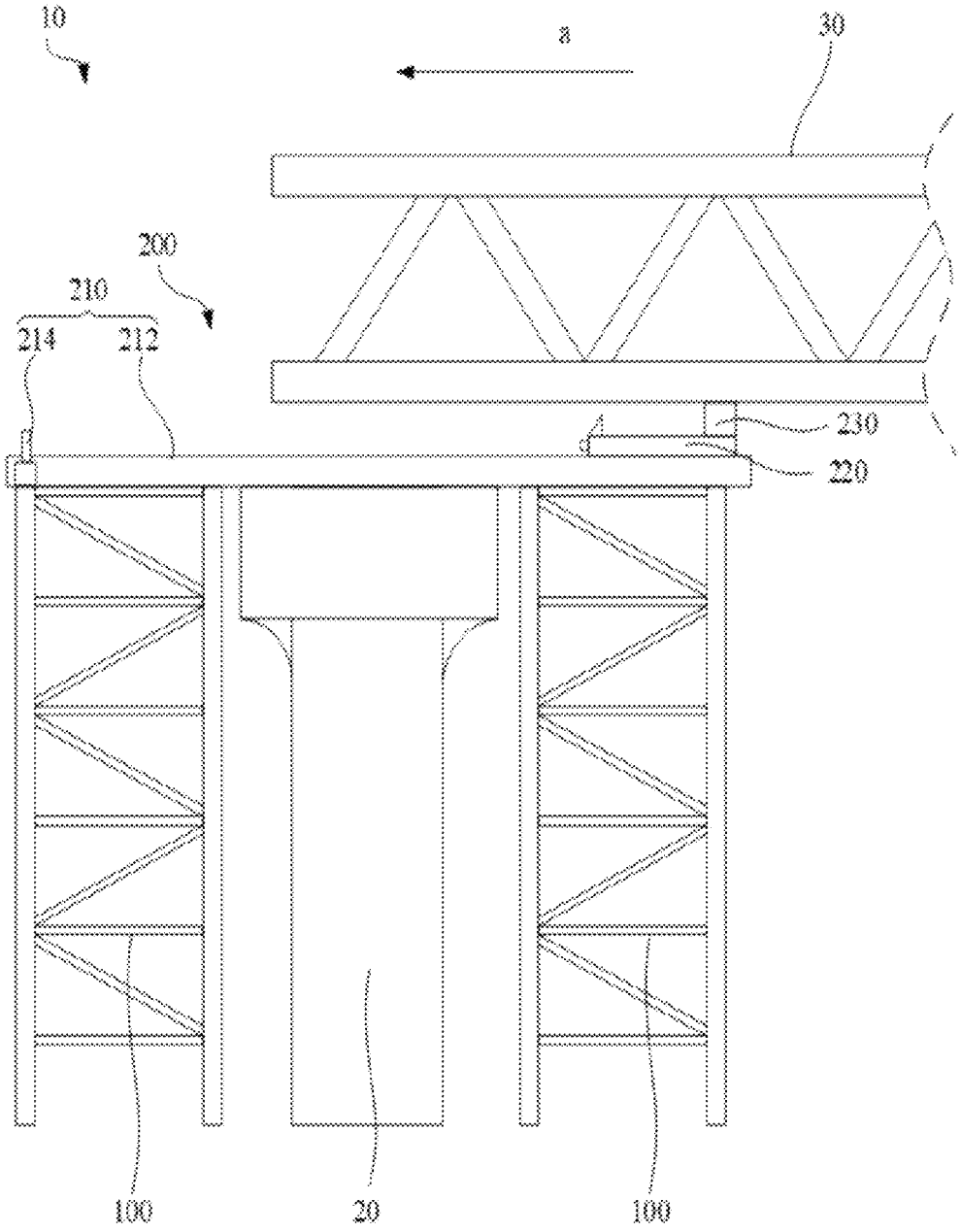

Additionally, the drawings are not drawn to scale, and the relative sizes of the various components are shown illustratively in the drawings and are not necessarily drawn to actual scale. In the drawings:

FIG. 1 is a schematic structural diagram of a bridge construction system in one embodiment.

Figure 2:
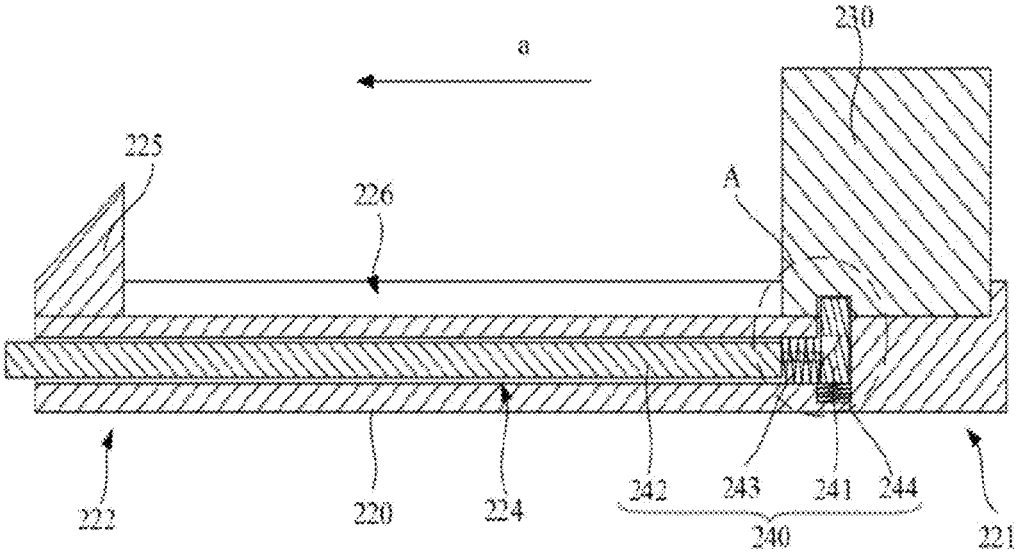

FIG. 2 is a cross-sectional view of the bridge sliding device in FIG. 1.

Figure 3:
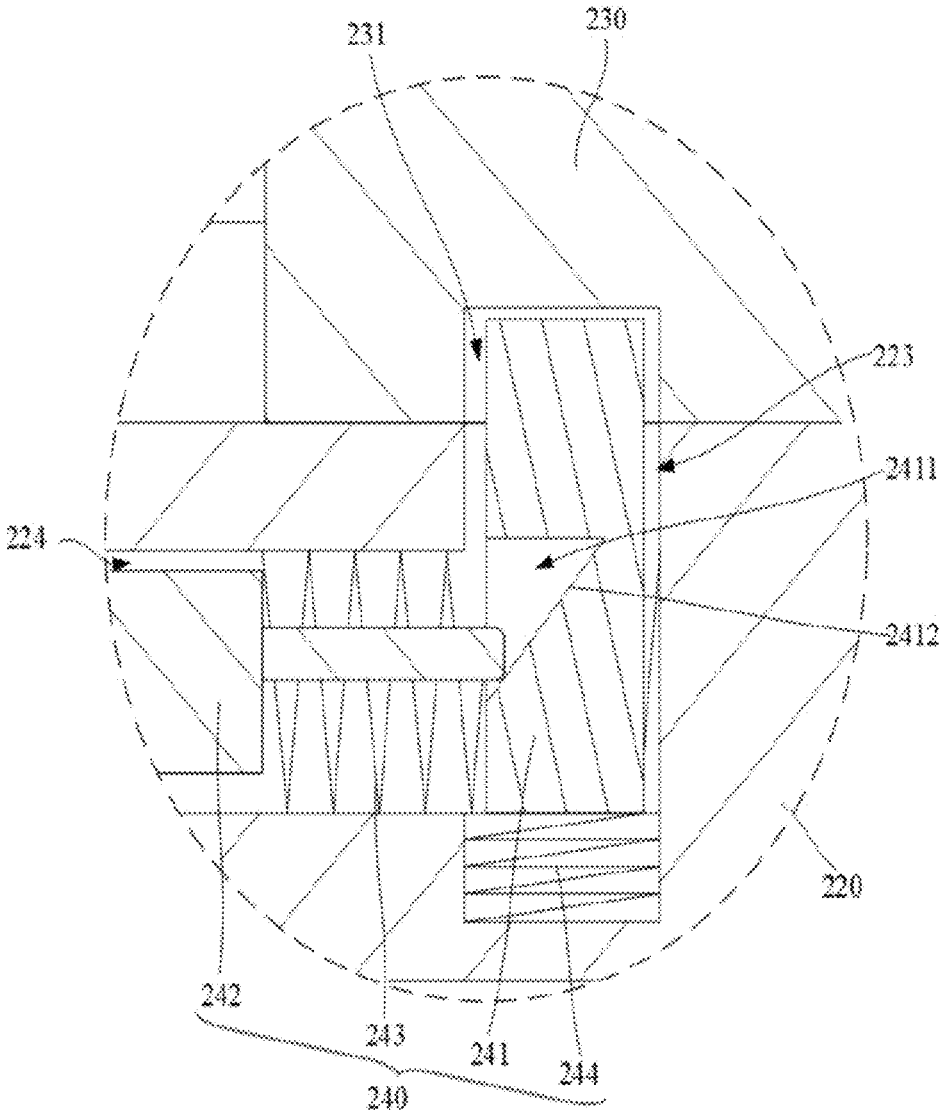

FIG. 3 is an enlarged view of the area A in FIG. 2.

Figure 4:
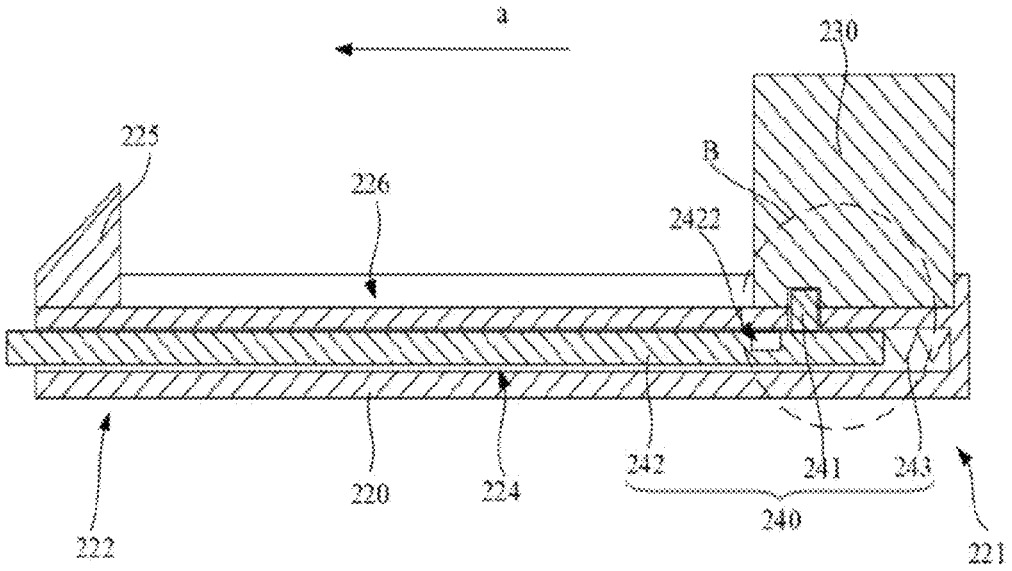

FIG. 4 is a cross-sectional view of another embodiment of the bridge sliding device.

Figure 5:
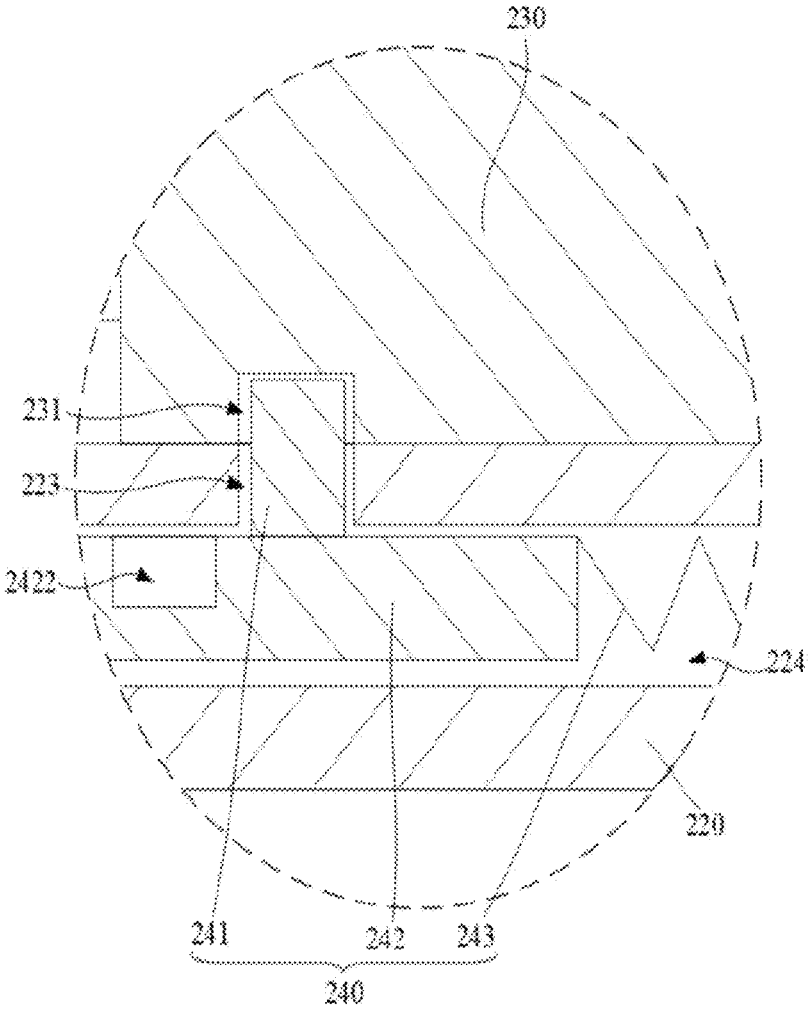

FIG. 5 is an enlarged view of the area B in FIG. 4.

The following reference numerals are used in the drawings: 10, bridge construction system; 100, temporary support platform; 200, bridge sliding device; 210, slide rail assembly; 212, rail; 214, limiting member; 220, first sliding component; 221, sliding start; 222, sliding end; 223, first locking hole; 224, moving hole; 225, stop; 226, sliding slot; 230, second sliding component; 231, second locking hole; 240, locking assembly; 241, locking pin; 2411, locking groove; 2412, contact slope; 242, locking pushrod; 2422, relief groove; 243, pushrod reset mechanism; 244, locking reset mechanism; 20, bridge pier; 30, bridge deck truss.

DETAILED DESCRIPTION

To make the above objectives, features, and advantages of this application more apparent, the specific embodiments of this application are described in detail below in conjunction with the drawings. In the following description, numerous specific details are set forth to provide a thorough understanding of this application. However, this application can be implemented in many other ways different from those described herein, and those skilled in the art can make similar modifications without departing from the essence of this application. Therefore, this application is not limited by the specific embodiments disclosed below.

Referring to FIG. 1 and FIG. 2, in one embodiment of this application, the bridge construction system 10 can at least improve construction efficiency and ensure progress. Specifically, the bridge construction system 10 includes a temporary support platform 100 and a bridge sliding device 200, where the temporary support platform 100 is set up on one side of the bridge pier 20, and the bridge sliding device 200 is arranged on the temporary support platform 100 and the bridge pier 20. The bridge sliding device 200 is used to achieve the lateral movement of the bridge deck truss 30, allowing the bridge deck truss 30 to slide onto the bridge pier 20.

Referring also to FIG. 3, specifically, the bridge sliding device 200 includes a slide rail assembly 210, a first sliding component 220, and a second sliding component 230. The slide rail assembly 210 includes a rail 212, which spans across the temporary support platform 100 and the bridge pier 20, and the rail 212 is arranged in the transverse direction a, which is the direction from one side of the temporary support platform 100 to the bridge pier 20. The first sliding component 220 is slidably arranged on the rail 212, with its opposite ends respectively forming a sliding start 221 and a sliding end 222, and the direction from the sliding start 221 to the sliding end 222 is the transverse direction a. The second sliding component 230 is unlockably locked onto the sliding start 221 of the first sliding component 220 and can slide from the sliding start 221 to the sliding end 222 of the first sliding component 220. The second sliding component 230 is used to support the bridge deck truss 30. The length of the second sliding component 230 is less than that of the first sliding component 220, and the length of the first sliding component 220 is less than that of the rail 212.

During construction, temporary support platforms 100 are first set up on both sides of the bridge pier 20, and then the slide rail assembly 210 is set up across the temporary support platforms 100 and the bridge pier 20, so that the rail 212 of the slide rail assembly 210 is arranged in the transverse direction a of the bridge deck truss 30. Due to the higher deformation resistance of the bridge pier 20 compared to the temporary support platform 100, the pressure from the bridge deck truss 30 on the temporary support platform 100 will cause it to deform, leading to a height difference between the temporary support platform 100 and the bridge pier 20, affecting the movement of the bridge deck truss 30 in the transverse direction a. If, to overcome the height difference caused by the deformation of the temporary support platform 100, the height of the temporary support platform 100 is set higher than that of the bridge pier 20 during installation, then due to the height difference between the temporary support platform 100 and the bridge pier 20 in the initial state, the slide rail assembly 210 cannot be effectively and reliably installed on the bridge pier 20, which affects the installation reliability of the slide rail assembly 210 with the bridge pier 20. This, in turn, although solving the height difference issue caused by the pressure of the bridge deck truss 30 on the temporary support platform 100, raises the problem of the installation reliability of the slide rail assembly 210, affecting the stability of the bridge deck truss 30 as it moves on the slide rail assembly 210 in the transverse direction a.

Using the above-mentioned bridge sliding device 200, since the first sliding component 220 is set on the rail 212, and the second sliding component 230 is set on the first sliding component 220, and the second sliding component 230 is shorter than the first sliding component 220, when the first sliding component 220 is aligned with the temporary support platform 100, the second sliding component 230 is locked onto the sliding start 221 of the first sliding component 220, and the bridge deck truss 30 is set on the second sliding component 230. The weight of the bridge deck truss 30, applied through the second sliding component 230 to the sliding start 221 of the first sliding component 220, causes the sliding end 222 of the first sliding component 220 to slightly tilt upwards. As the first sliding component 220 slides on the rail 212, the sliding end 222 of the first sliding component 220 can easily cross the junction between the temporary support platform 100 and the bridge pier 20. When the second sliding component 230 moves with the first sliding component 220 to the junction, the sliding end 222 of the first sliding component 220 has already moved onto the bridge pier 20, allowing the sliding start 221 of the first sliding component 220 to more easily cross the junction, thereby making it easier for the second sliding component 230 to cross the junction as well. After the first sliding component 220 is in position, the locking of the second sliding component 230 relative to the first sliding component 220 can be released, allowing the bridge deck truss 30 to push the second sliding component 230 to continue sliding from the sliding start 221 to the sliding end 222 of the first sliding component 220, increasing the travel distance of the bridge deck truss 30 in the transverse direction a. This bridge sliding device 200, by utilizing the cooperation between the first sliding component 220 and the second sliding component 230, allows the second sliding component 230 to more smoothly cross the junction between the temporary support platform 100 and the bridge pier 20, ensuring the efficiency of the bridge deck truss's incremental launching construction.

In one embodiment, the bridge construction system 10 further includes a pushing assembly (not shown), which is set on the temporary support platform 100 and is used to push the bridge deck truss 30 in the transverse direction a. During construction, the bridge deck truss 30 is set on the second sliding component 230, and the pushing assembly pushes the bridge deck truss 30 along the transverse direction a, allowing the bridge deck truss 30 to move using the second sliding component 230 and the first sliding component 220 sliding on the rail 212, thereby achieving the movement of the bridge deck truss 30. By providing the pushing assembly, power can be provided for the movement of the bridge deck truss 30.

In one embodiment, the bridge construction system 10 further includes a jacking assembly (not shown), which is set on the temporary support platform 100. The jacking assembly can move up and down relative to the temporary support platform 100 and is used to lift the bridge deck truss 30 from the second sliding component 230. When the bridge deck truss 30 is moved into place through the first sliding component 220 and the second sliding component 230, the jacking assembly rises relative to the temporary support platform 100 to lift the bridge deck truss 30 from the second sliding component 230, allowing the bridge deck truss 30 to separate from the second sliding component 230. At this time, the slide rail assembly 210, the first sliding component 220, and the second sliding component 230 can be disassembled from the bridge pier 20. The jacking assembly then lowers the bridge deck truss 30, placing the bridge deck truss 30 on the bridge pier 20, achieving the purpose of moving the bridge deck truss 30 to the bridge pier 20 and positioning it on the pier.

Specifically, the jacking assembly can be a jack. The number of jacking assemblies can be two, with each jacking assembly set on the temporary support platform 100 on either side of the bridge pier 20, allowing the bridge deck truss 30 to be lifted from both sides, increasing the reliability of lifting the bridge deck truss 30.

As shown in FIG. 1, in one embodiment, the length of the first sliding component 220 is less than the length of the temporary support platform 100 in the transverse direction a. When the length of the temporary support platform 100 is relatively large, the length of the first sliding component 220 can be less than that of the temporary support platform 100. Since the weight of the bridge deck truss 30 is applied through the second sliding component 230 to the sliding start 221 of the first sliding component 220, it facilitates the sliding end 222 of the first sliding component 220 to effectively cross onto the bridge pier 20, avoiding the installation of an overly long first sliding component 220, which would increase the friction between the first sliding component 220 and the rail 212, as well as the cost of the first sliding component 220.

Of course, in other embodiments, the length of the first sliding component 220 can be greater than the length of the temporary support platform 100 in the transverse direction a. In the initial state, the sliding end 222 of the first sliding component 220 would already be positioned on the bridge pier 20, and the sliding start 221 of the first sliding component 220 would be on the temporary support platform 100, further avoiding the need for the first sliding component 220 to span the junction between the temporary support platform 100 and the bridge pier 20 during sliding.

In one embodiment, the friction coefficient between the first sliding component 220 and the rail 212 is less than the friction coefficient between the second sliding component 230 and the first sliding component 220. When the bridge deck truss 30 is pushed along the transverse direction a, since the friction coefficient between the first sliding component 220 and the rail 212 is less than that between the second sliding component 230 and the first sliding component 220, it will cause the first sliding component 220 to slide first on the rail 212, or the sliding speed of the first sliding component 220 on the rail 212 to be greater than that of the second sliding component 230 on the first sliding component 220. Therefore, when the first sliding component 220 has not slid into place, the second sliding component 230 moves slowly or does not move on the sliding start 221 of the first sliding component 220, effectively locking the second sliding component 230 onto the first sliding component 220. Thus, when the first sliding component 220 spans the junction between the temporary support platform 100 and the bridge pier 20, the second sliding component 230 has not yet slid to the sliding end 222 of the first sliding component 220, allowing the sliding end 222 of the first sliding component 220 to smoothly slide onto the bridge pier 20, and the second sliding component 230 then slides from the sliding start 221 to the sliding end 222 of the first sliding component 220, smoothly crossing the junction between the temporary support platform 100 and the bridge pier 20.

Referring to FIGS. 1 to 3, in one embodiment, the bridge sliding device 200 further includes a locking assembly 240, which is set on the first sliding component 220. In the initial state, the locking assembly 240 is used to lock the second sliding component 230 at the sliding start 221 of the first sliding component 220. After the first sliding component 220 slides into place, the locking assembly 240 is used to release the lock on the second sliding component 230. By setting the locking assembly 240, the reliability of locking the second sliding component 230 at the sliding start 221 of the first sliding component 220 is increased. In the initial state, it can be understood that the first sliding component 220 is located on the temporary support platform 100, ready to slide in the direction of the bridge pier 20. At this time, the second sliding component 230 is locked onto the first sliding component 220 by the locking assembly 240, increasing the smoothness with which the first sliding component 220 crosses the junction between the temporary support platform 100 and the bridge pier 20. After the first sliding component 220 slides into place, the locking assembly 240 releases the lock on the second sliding component 230, allowing the second sliding component 230 to slide relative to the first sliding component 220, thereby enabling the bridge deck truss 30 to move into place.

Specifically, the locking assembly 240 includes a locking pin 241, a locking pushrod 242, and a pushrod reset mechanism 243. The first sliding component 220 has a first locking hole 223 on the side facing the second sliding component 230, and the second sliding component 230 has a second locking hole 231 on the side facing the first sliding component 220. One end of the locking pin 241 is inserted into the first locking hole 223, and the other end can be inserted into the second locking hole 231. The first sliding component 220 also has a moving hole 224 communicating with the first locking hole 223, which runs through the sliding end 222. The locking pushrod 242 is movably inserted into the moving hole 224 along the transverse direction a, and the pushrod reset mechanism 243 applies a reset force along the transverse direction a to the locking pushrod 242. The locking pushrod 242 moves within the moving hole 224, driving the locking pin 241 to move from the second locking hole 231 to the first locking hole 223, disengaging the second locking hole 231.

In the locked state, one end of the locking pin 241 is inserted into the first locking hole 223, and the other end is inserted into the second locking hole 231, using the locking pin 241 to prevent the second sliding component 230 from moving relative to the first sliding component 220. After the first sliding component 220 moves into place, the locking pushrod 242 is pushed to move within the moving hole 224, driving the locking pin 241 to move from the second locking hole 231 to the first locking hole 223, disengaging the second locking hole 231, and at this time, the pushrod reset mechanism 243 stores energy. After the locking pin 241 exits the second locking hole 231, the lock on the second sliding component 230 is released, allowing the second sliding component 230 to slide on the first sliding component 220. In one embodiment, when the bridge sliding device 200 is reused, the pushrod reset mechanism 243 releases the stored energy, resetting the locking pushrod 242, and the locking pin 241 resets, allowing the locking pin 241 to reinsert into the second locking hole 231 from the first locking hole 223.

In one embodiment, one end of the locking pin 241 is inserted through the first locking hole 223 into the moving hole 224. The portion of the locking pin 241 located within the moving hole 224 has a locking groove 2411 on the side facing the locking pushrod 242, and the locking groove 2411 forms a contact slope 2412, inclined along the transverse direction a, away from the second locking hole 231. One end of the locking pushrod 242 can contact the contact slope 2412. The locking assembly 240 further includes a locking reset mechanism 244 that applies a reset force to the locking pin 241 along the direction from the first locking hole 223 to the second locking hole 231.

After the first sliding component 220 moves into place, the locking pushrod 242 is pushed within the moving hole 224 in the opposite direction along the transverse direction a, towards the locking groove 2411 of the locking pin 241. The locking pushrod 242 contacts the contact slope 2412, using the contact slope 2412 to press down the locking pin 241, causing the locking pin 241 to move from the second locking hole 231 to the first locking hole 223, disengaging the second locking hole 231. At this time, the locking reset mechanism 244 is compressed and stores energy, and the pushrod reset mechanism 243 is also compressed and stores energy. After releasing the push on the locking pushrod 242, the locking reset mechanism 244 releases the stored energy, resetting the locking pin 241, and the pushrod reset mechanism 243 releases the stored energy, resetting the locking pushrod 242.

Referring to FIG. 4 and FIG. 5, in another embodiment, the locking pushrod 242 has a relief groove 2422 on the side facing the first locking hole 223, and the other end extends out of the moving hole 224. The locking pushrod 242 moves in the direction from the sliding end 222 to the sliding start 221, aligning the relief groove 2422 with the first locking hole 223, allowing the locking pin 241 to drop from the second locking hole 231 into the first locking hole 223 and the relief groove 2422. In the locked state, the relief groove 2422 is misaligned with the first locking hole 223, and the locking pin 241 is supported on the outer surface of the locking pushrod 242 through the moving hole 224. When the first sliding component 220 moves into place, the locking pushrod 242 is pushed to move within the moving hole 224 in the opposite direction along the transverse direction a, aligning the relief groove 2422 with the first locking hole 223, allowing the locking pin 241 to drop from the first locking hole 223 into the relief groove 2422, thereby disengaging the second locking hole 231 and unlocking the second sliding component 230. The pushrod reset mechanism 243 can maintain the locking pushrod 242 in a state where the relief groove 2422 is misaligned with the first locking hole 223 without external force, ensuring the reliability of locking the second sliding component 230.

Referring to FIG. 1, FIG. 2, and FIG. 4, in one embodiment, the sliding end 222 of the first sliding component 220 is provided with a stop 225, and a sliding slot 226 is formed on the first sliding component 220 in the transverse direction a. The second sliding component 230 is slidably arranged within the sliding slot 226 and can slide within it and contact the stop 225. By setting the sliding slot 226, the reliability of the second sliding component 230 sliding on the first sliding component 220 can be improved. By setting the stop 225, the sliding position of the second sliding component 230 can be limited, ensuring that the second sliding component 230 moves the bridge deck truss 30 to the desired position. In other embodiments, the stop 225 can be omitted, and the end wall of the sliding slot 226 can be used for limiting.

In one embodiment, the slide rail assembly 210 further includes a limiting member 214, which is set on the rail 212, and the first sliding component 220 can slide on the rail 212 and contact the limiting member 214. By setting the limiting member 214, the sliding position of the first sliding component 220 can be limited. When the first sliding component 220 moves in the direction of the limiting member 214, the locking pushrod 242 first contacts the limiting member 214, causing the limiting member 214 to push the locking pushrod 242, allowing the locking pushrod 242 to unlock the second sliding component 230 from the locking pin 241. After the first sliding component 220 contacts the limiting member 214, the locking pushrod 242 drives the locking pin 241 to unlock the second sliding component 230, allowing the second sliding component 230 to continue sliding on the first sliding component 220.

Specifically, the limiting member 214 is movably set on the rail 212, and the direction of movement of the limiting member 214 relative to the rail 212 is the transverse direction a. By controlling the movement of the limiting member 214 on the rail 212, the sliding position of the first sliding component 220 can be limited, thereby limiting the movement position of the bridge deck truss 30, improving the accuracy of placing the bridge deck truss 30 on the bridge pier 20.

Furthermore, the limiting member 214 is retractable relative to the rail 212. By retracting the limiting member 214 relative to the rail 212, it can be adjusted to determine whether the limiting member 214 limits the position of the first sliding component 220, adapting to different situations of lateral movement of the bridge deck truss 30.

The above-mentioned bridge sliding device 200, through the cooperation of the first sliding component 220 and the second sliding component 230, allows the bridge deck truss 30 to smoothly cross the junction between the temporary support platform 100 and the bridge pier 20 during lateral movement, effectively ensuring the efficiency of the bridge deck truss 30 incremental launching construction.

In the description of this application, it should be understood that terms such as "center," "longitudinal," "transverse," "length," "width," "thickness," "upper," "lower," "front," "rear," "left," "right," "vertical," "horizontal," "top," "bottom," "inside," "outside," "clockwise," "counterclockwise," "axial," "radial," "circumferential," and similar terms indicating orientation or positional relationships are based on the orientation or positional relationships shown in the drawings. These terms are provided to facilitate the description of the present application and to simplify the description, rather than to indicate or imply that the referenced device or component must have a specific orientation, be constructed, or operate in a specific orientation. Therefore, these terms should not be construed as limiting the present application.

Moreover, terms such as "first" and "second" are used for descriptive purposes only and should not be construed as indicating relative importance or implicitly specifying the number of technical features referred to. Thus, features defined as "first" and "second" may explicitly or implicitly include at least one of those features. In the description of this application, the term "multiple" means at least two, for example, two, three, etc., unless otherwise explicitly specified.

In this application, unless otherwise explicitly specified and defined, terms such as "installation," "connection," "coupling," "fixing," and similar terms should be understood broadly. For example, they may refer to fixed connections, removable connections, or integral formations; they may refer to mechanical connections or electrical connections; they may refer to direct connections or indirect connections through intermediate media; they may refer to the internal communication of two components or the interaction relationship between two components, unless otherwise explicitly specified. For those skilled in the art, the specific meanings of these terms in this application can be understood based on the specific context.

In this application, unless otherwise explicitly specified and defined, descriptions such as "on" or "under" for the first feature relative to the second feature may mean direct contact between the first and second features or indirect contact through intermediate media. Moreover, "on," "above," and "over" for the first feature relative to the second feature may mean that the first feature is directly above or diagonally above the second feature, or merely that the first feature is at a higher horizontal level than the second feature. "Under," "below," and "beneath" for the first feature relative to the second feature may mean that the first feature is directly below or diagonally below the second feature, or merely that the first feature is at a lower horizontal level than the second feature.

It should be noted that if a component is described as being "fixed to" or "arranged on" another component, it can be directly on the other component or there may also be an intermediary component. If a component is described as being "connected to" another component, it can be directly connected to the other component or there may also be an intermediary component. Furthermore, the terms "vertical," "horizontal," "upper," "lower," "left," "right," and similar expressions used in this application are for descriptive purposes only and do not represent the only embodiments.

The various technical features of the above-described embodiments can be combined in any suitable manner. For simplicity of description, not all possible combinations of the above technical features are described. However, as long as there is no contradiction between these technical features, it should be considered within the scope of the present disclosure.

The above-described embodiments only express a few embodiments of the present application. Their descriptions are specific and detailed, but they should not be understood as limiting the scope of the patent claims. It should be noted that for those skilled in the art, without departing from the concept of the present application, several modifications and improvements can be made. These all fall within the scope of the present application. Therefore, the scope of the patent should be defined by the appended claims.

What is claimed is:

1. A bridge sliding device, comprising:

a slide rail assembly, the slide rail assembly comprising a rail configured to span across a temporary support platform and a bridge pier, the rail arranged along a transverse direction from the temporary support platform toward the bridge pier;

a first sliding component slidably disposed on the rail, the first sliding component having a sliding start end and a sliding end opposite each other in the transverse direction; and a second sliding component unlockably locked to the sliding start end of the first sliding component, the second sliding component capable of sliding from the sliding start end to the sliding end of the first sliding component, the second sliding component configured to support a bridge deck truss, wherein the length of the second sliding component is less than the length of the first sliding component, and the length of the first sliding component is less than the length of the rail.

2. The bridge sliding device according to claim 1, further comprising a locking assembly, the locking assembly disposed on the first sliding component, wherein in an initial state, the locking assembly is configured to lock the second sliding component at the sliding start end of the first sliding component, and after the first sliding component slides into position, the locking assembly is configured to release the lock on the second sliding component.

3. The bridge sliding device according to claim 2, wherein the locking assembly comprises a locking pin, a locking pushrod, and a pushrod reset mechanism, the first sliding component having a first locking hole on a side facing the second sliding component, the second sliding component having a second locking hole on a side facing the first sliding component, one end of the locking pin inserted into the first locking hole and the other end capable of being inserted into the second locking hole; the first sliding component further having a moving hole communicating with the first locking hole, the moving hole running through the sliding end, one end of the locking pushrod reciprocally disposed in the moving hole along the transverse direction, the pushrod reset mechanism configured to apply a reset force along the transverse direction to the locking pushrod, wherein movement of the locking pushrod within the moving hole drives the locking pin to move from the second locking hole to the first locking hole, thereby disengaging the second locking hole.

4. The bridge sliding device according to claim 3, wherein the locking pushrod has a relief groove on a side facing the first locking hole, the other end of the locking pushrod extending out of the moving hole, the locking pushrod moving from the sliding end to the sliding start end to align the relief groove with the first locking hole, enabling the locking pin to drop from the second locking hole into the first locking hole and the relief groove; or wherein one end of the locking pin is inserted into the moving hole through the first locking hole, the portion of the locking pin within the moving hole having a locking groove on a side facing the locking pushrod, the locking groove forming a contact slope, the contact slope inclined in the transverse direction away from the second locking hole, the one end of the locking pushrod capable of contacting the contact slope;

locking assembly further comprising a locking reset mechanism configured to apply a reset force to the locking pin along the direction from the first locking hole to the second locking hole.

5. The bridge sliding device according to claim 1, wherein the sliding end of the first sliding component is provided with a stop, the first sliding component having a sliding slot arranged in the transverse direction, the second sliding component slidably disposed within the sliding slot, the second sliding component capable of sliding within the sliding slot and contacting the stop.

6. The bridge sliding device according to claim 1, further comprising a limiting member, the limiting member movably disposed on the rail, the direction of movement of the limiting member relative to the rail being the transverse direction, the first sliding component capable of sliding on the rail and contacting the limiting member.

7. The bridge sliding device according to claim 1, wherein the length of the first sliding component is less than the length of the temporary support platform in the transverse direction.

8. The bridge sliding device according to claim 1, wherein the friction coefficient between the first sliding component and the rail is less than the friction coefficient between the second sliding component and the first sliding component.

9. A bridge construction system, comprising:

a temporary support platform, the temporary support platform set up on one side of a bridge pier; and a bridge sliding device, wherein the bridge sliding device comprises:

a slide rail assembly, the slide rail assembly comprising a rail configured to span across a temporary support platform and a bridge pier, the rail arranged along a transverse direction from the temporary support platform toward the bridge pier;

a first sliding component slidably disposed on the rail, the first sliding component having a sliding start end and a sliding end opposite each other in the transverse direction; and a second sliding component unlockably locked to the sliding start end of the first sliding component, the second sliding component capable of sliding from the sliding start end to the sliding end of the first sliding component, the second sliding component configured to support a bridge deck truss, wherein the length of the second sliding component is less than the length of the first sliding component, and the length of the first sliding component is less than the length of the rail, wherein the slide rail assembly spanning the temporary support platform and the bridge pier, the first sliding component capable of sliding along the rail from the temporary support platform to the bridge pier, and the second sliding component capable of sliding from the sliding start end to the sliding end of the first sliding component.

10. The bridge construction system of claim 9, further comprising a pushing assembly, the pushing assembly set up on the temporary support platform, the pushing assembly configured to push the bridge deck truss in the transverse direction; and/or further comprising a jacking assembly, the jacking assembly set up on the temporary support platform, the jacking assembly capable of moving up and down relative to the temporary support platform and configured to lift the bridge deck truss from the second sliding component.

* * * * *